US008044979B2

(12) United States Patent
Ko

(10) Patent No.: US 8,044,979 B2
(45) Date of Patent: Oct. 25, 2011

(54) ACTIVE DISPLAY DEVICE AND MIXING TYPE PIXEL DRIVING METHOD IN ACTIVE DISPLAY DEVICE

(75) Inventor: Jae Gan Ko, Bucheon-si (KR)

(73) Assignee: TLI Inc., Seongnam-si, Gyeonggi-do (KR)

( * ) Notice: Subject to any disclaimer, the term of this patent is extended or adjusted under 35 U.S.C. 154(b) by 705 days.

(21) Appl. No.: 12/034,795

(22) Filed: Feb. 21, 2008

(65) Prior Publication Data

US 2009/0051708 A1 Feb. 26, 2009

(30) Foreign Application Priority Data

Aug. 20, 2007 (KR) ..... 10-2007-0083328

(51) Int. Cl.
*G09G 5/10* (2006.01)

(52) U.S. Cl. ..... 345/690; 345/76; 345/204; 345/89

(58) Field of Classification Search ..... 345/76–102
See application file for complete search history.

(56) References Cited

U.S. PATENT DOCUMENTS 6,094,187 A * 7/2000 Jones et al. ..... 345/690
7,692,672 B2 * 4/2010 Jones et al. ..... 345/694

FOREIGN PATENT DOCUMENTS

KR 1020040020431 A 3/2004
KR 1020060020972 A 3/2006
KR 1020070019882 A 2/2007
WO 2005022499 A1 3/2005
WO 2005081217 A1 9/2005

* cited by examiner

*Primary Examiner* — Duc Dinh
(74) *Attorney, Agent, or Firm* — Kile Park Goekjian Reed & McManus PLLC

(57) ABSTRACT

A mixing type pixel driving method in an active display device includes generating a digital data for a selected pixel, first driving the selected pixel to be illuminated with a first illumination intensity, and second driving the selected pixel to be illuminated with a second illumination intensity in a second illumination interval. A relative ratio of the second illumination intensity to the first illumination intensity is changed according to the value of the digital data. The number of the converted bits by DAC is reduced. Therefore, the less bit DAC is adaptable for the mixing type pixel driving method and the layout area and the consumption current can be decreased.

17 Claims, 7 Drawing Sheets

ACTIVE DISPLAY DEVICE AND MIXING TYPE PIXEL DRIVING METHOD IN ACTIVE DISPLAY DEVICE

This application claims priority to Korean Application No. 10-2007-083328, filed on Aug. 20, 2007, and all the benefits accruing therefrom under 35 U.S.C. §119, the contents of which in its entirety are herein incorporated by reference.

BACKGROUND OF THE INVENTION

1. Field of the Invention

The present invention relates to an active display device and a driving method for a pixel of an active display device. More particularly, the present invention relates to an active display device and a driving method for a pixel of an active display device having a decreased layout area and consumption current.

2. Description of the Related Art

Recently, active display devices such as active matrix organic lighting emitting diodes ("AMOLEDs") are widely used for various electronic equipments. In the active display device, a pixel selected is driven to be illuminated for displaying an image data on a display panel. At this time, the illuminance is determined according to corresponding digital data.

Meanwhile, one of the conventional methods for driving the pixel is an 'analog type driving method'. According to the analog type driving method, the selected pixel is illuminated with a constant illumination intensity during one unit frame period, as shown in FIG. 1. In the analog type driving method, the number of the intensity levels to be selectable corresponds to the bit number of the digital data. For example, if the bit number of the digital data is 4, then the number of the intensity levels is 16 ($=2^4$).

In the analog type driving method, the bit number to be converted is the same as the bit number of the digital data. For example, if the bit number of the digital data is 4, then 4 bits are required to be converted. Thus, 4 bit digital to analog conversion ("DAC") is required for the analog type driving method.

In the analog type driving method, the bit number to be converted is increased as the bit number of the digital data is increased. Also, the layout area for DAC is increased as the number of the converted bits is increased. Furthermore, the consumption current for DAC is increased as the number of the converted bits is increased.

BRIEF SUMMARY OF THE INVENTION

Accordingly, the present invention provides an active display device and a driving method for a pixel of an active display device which decreases the layout area and consumption current.

In accordance with exemplary embodiments of the present invention, a method of driving an active display device includes generating a digital data for a selected pixel, first driving the selected pixel to be illuminated with a first illumination intensity in a first illumination interval, and second driving the selected pixel to be illuminated with a second illumination intensity in a second illumination interval. The first and the second illumination intensity levels, and the first and the second illumination intervals are determined in a mapping table according to the digital data. The first illumination interval and the second illumination interval are included in one unit frame period. The length of the first illumination interval and the length of the second illumination interval are independent from the digital data. The relative ratio of the second illumination intensity to the first illumination intensity is changed according to a value of the digital data.

In accordance with exemplary embodiments of the present invention, the method of driving an active display device may include generating a digital data for a selected pixel, first driving the selected pixel to be illuminated with a first illumination intensity in a first illumination interval, and second driving the selected pixel to be illuminated with a second illumination intensity in a second illumination interval, wherein, the first illumination interval and the second illumination interval are included in one unit frame period, and for each of a plurality of different illuminating amounts of the selected pixel, a mapping table stores a first illumination intensity, a first illumination interval, a second illumination intensity, and a second illumination interval according to the digital data.

In accordance with other exemplary embodiments of the present invention an active display device includes a display panel and a driving circuit. The display panel includes a plurality of pixels. The driving circuit generates a digital data for a selected pixel, and drives the selected pixel to be illuminated with a first illumination intensity in a first illumination interval, and drives the selected pixel to be illuminated with a second illumination intensity in a second illumination interval. The first illumination intensity and the second illumination intensity are determined according to the digital data. The first illumination interval and the second illumination interval are included in one unit frame period. The length of the first illumination interval and the length of the second illumination interval are independent from the digital data. The relative ratio of the second illumination intensity to the first illumination intensity is changed according to a value of the digital data.

BRIEF DESCRIPTION OF THE DRAWINGS

The above and other features and advantages of the present invention will be more clearly understood from the following detailed description taken in conjunction with the accompanying drawings, in which.

DETAILED DESCRIPTION OF THE INVENTION

'Bloch's law', also known as Bunsen-Roscoe law, tells about short time stimulation. According to 'Bloch's law', for short time-stimulation, if the product of stimulation intensity and stimulation time is the same, then there is little difference to the recognition human for stimulation. It may be expressed as $l \times t = k$, where l is the intensity of a flash or stimulation, t is its duration or stimulation time, and k is a constant.

Figure 2:
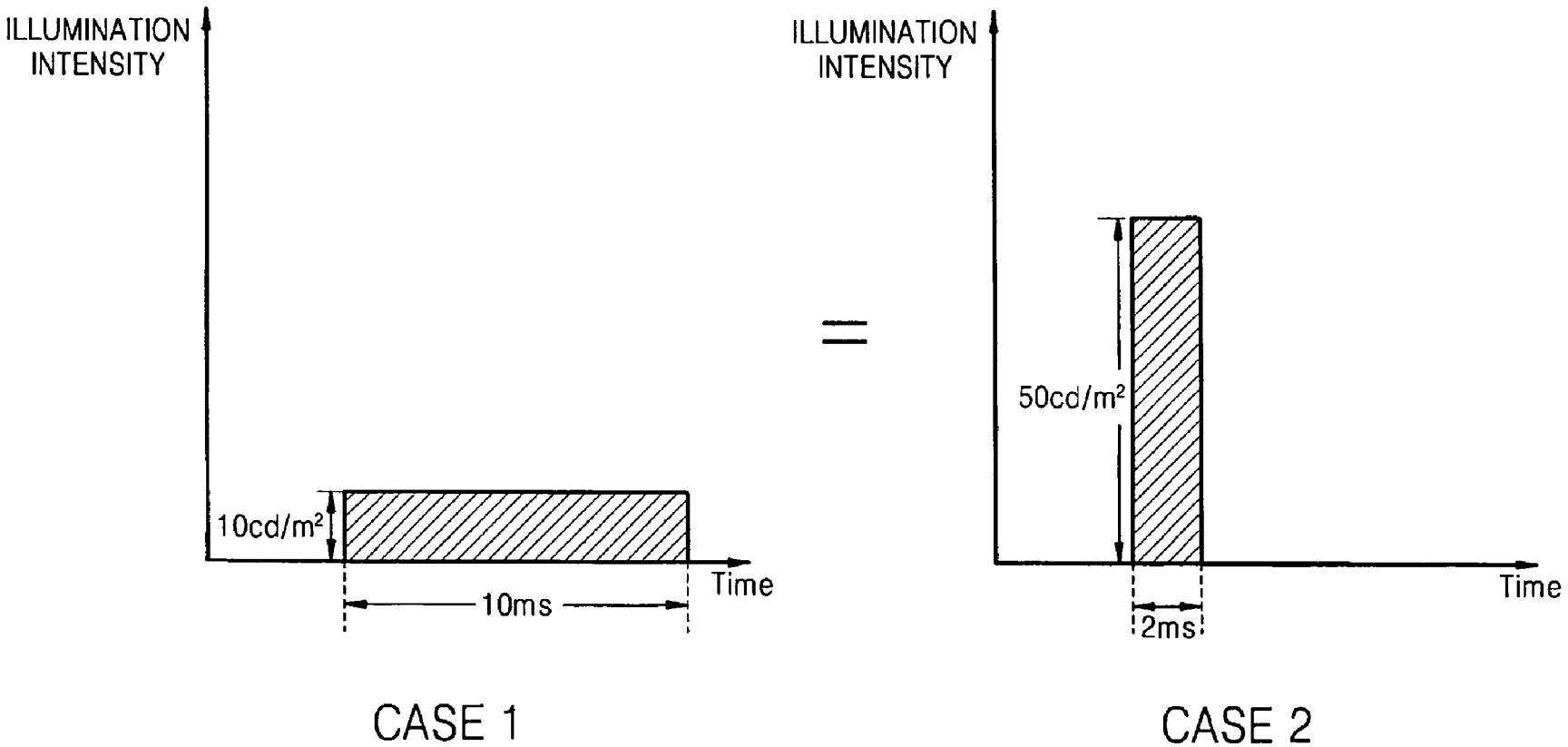
FIG. 2 is a drawing for explaining Bloch's law.

Referring to FIG. 2, CASE 1 shows that the stimulation time is 10 ms and the stimulation intensity is 10 cd/m$^2$. CASE 2 shows that the stimulation time is 2 ms and the stimulation intensity is 50 cd/m$^2$. Then, the product of stimulation intensity and stimulation time in CASE 1 is same as that in CASE2.

Thus, because the product, or constant k, is the same for both CASE 1 and CASE 2, a human cannot recognize the difference in stimulation between CASE 1 and CASE 2.

Hereinafter, exemplary embodiments of the present invention will be described in detail with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the thickness of layers, films, and regions may be exaggerated for clarity.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be described in detail with reference to the accompanying drawings. In the following description of the present invention, detailed descriptions may be omitted if it is determined that the detailed descriptions of related well-known functions and construction may make the gist of the present invention unclear.

Figure 3:
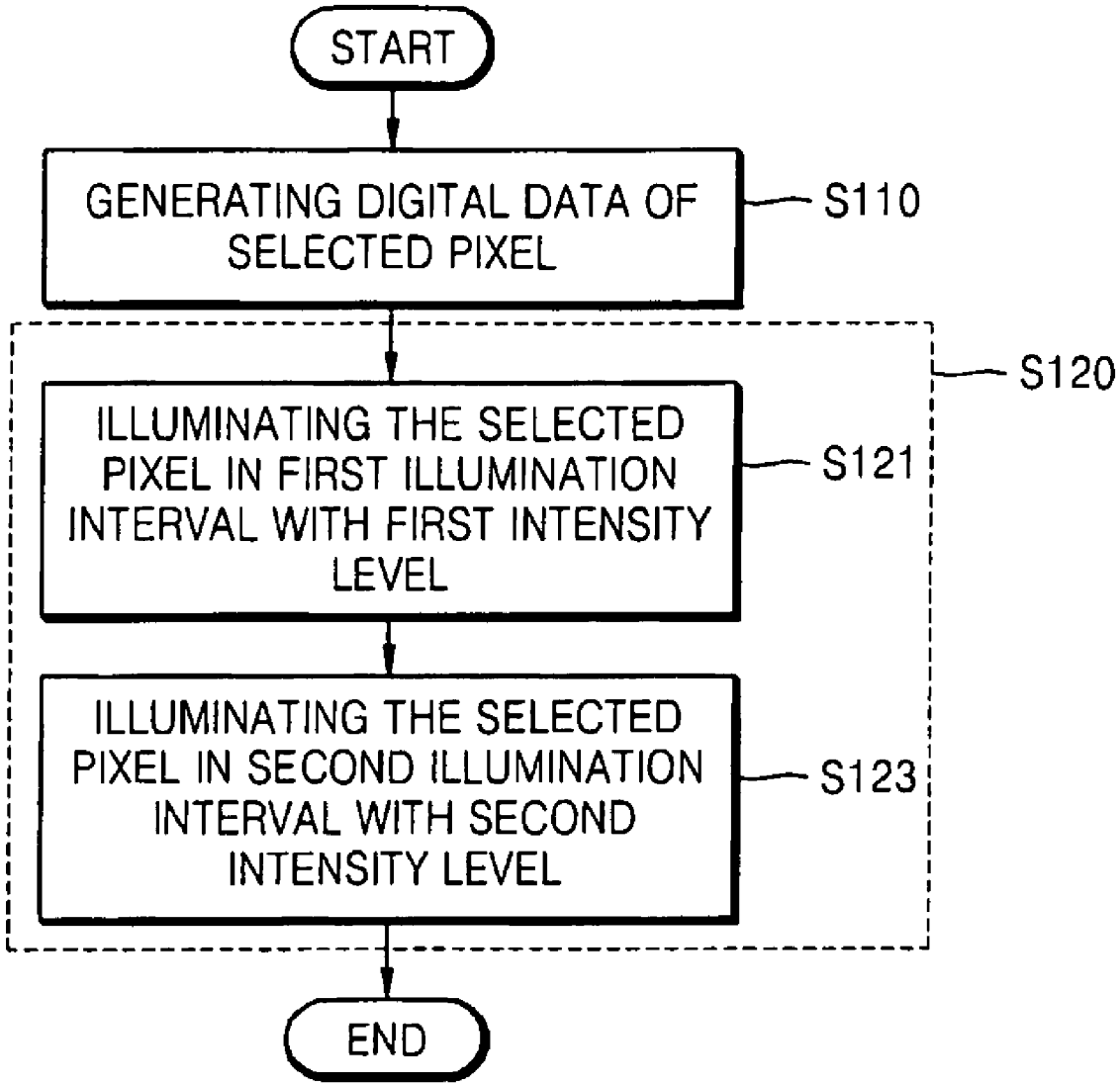
FIG. 3 is a flow diagram showing an exemplary driving method for a pixel of an exemplary active display device according to an exemplary embodiment of the present invention.

FIG. 3 is a flow diagram showing an exemplary driving method for a pixel of an exemplary active display device according to an exemplary embodiment of the present invention. The driving method of the present invention uses 'Bloch's law'. The driving method of the present invention may be referred to as a "mixing type pixel driving method".

Referring to FIG. 3, at step S110, a digital data is generated for a selected pixel.

At step S120, the selected pixel is driven to be illuminated. At this time, the illumination intensity can be variable as more than two intensity levels among more than three selectable intensity levels in one unit frame period.

Step S120 includes a step S121 and a step S123. At step S121, the selected pixel is driven to be illuminated with a first illumination intensity in a first illumination interval. Herein, the first illumination intensity and the first illumination interval are determined according to the digital data with reference to a mapping table. But the length of the first illumination interval is independent from the digital data.

At step S123, the selected pixel is driven to be illuminated with a second illumination intensity in a second illumination interval. Herein, the second illumination intensity and the second illumination interval are determined according to the digital data with reference to the mapping table. But the length of the second illumination interval is independent from the digital data.

Figure 4:
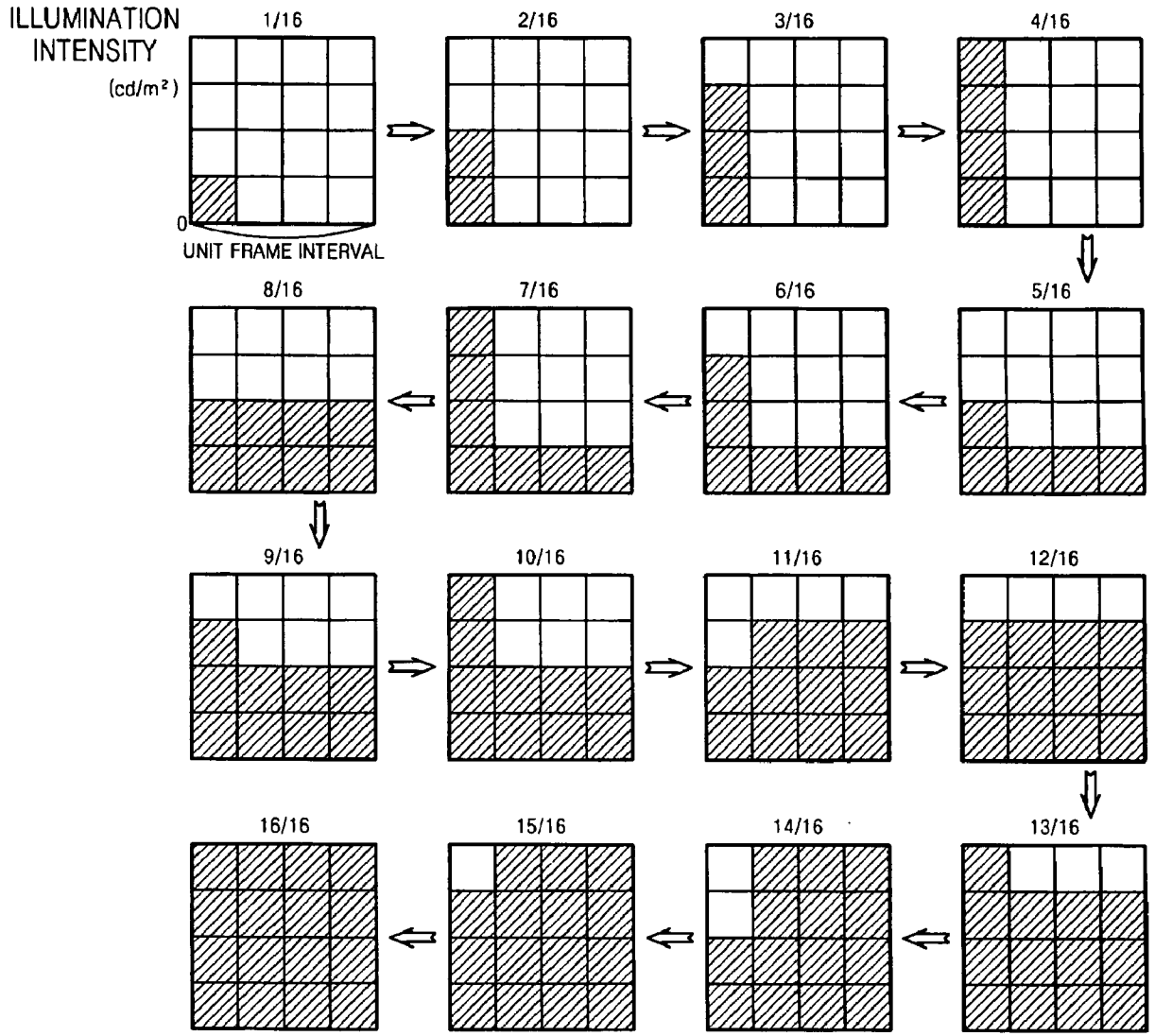
FIG. 4 shows an exemplary mapping table adoptable for the exemplary driving method of the present invention.

FIG. 4 shows an exemplary mapping table adoptable for the exemplary driving method of the present invention. In the mapping table of FIG. 4, the bit number of the digital data is 4.

From FIG. 4, it can be understood that the illumination intensity and the illumination interval corresponds to the digital data. In FIG. 4, the deviant lined area shows an illuminating amount. Herein, the corresponding illuminating amount is the product of the illumination intensity and the illumination time of the digital data. And, the ratio of the deviant lined area to the maximum area depends on the value of the digital data. Also, the ratio of the deviant lined area to the maximum area is the same as that of the corresponding illuminating amount to the maximum illuminating amount. Herein, the maximum area is defined by the product of the maximum intensity level and the unit time period. And, the maximum illuminating amount is the product of the maximum intensity level and the unit time period.

Figure 5:
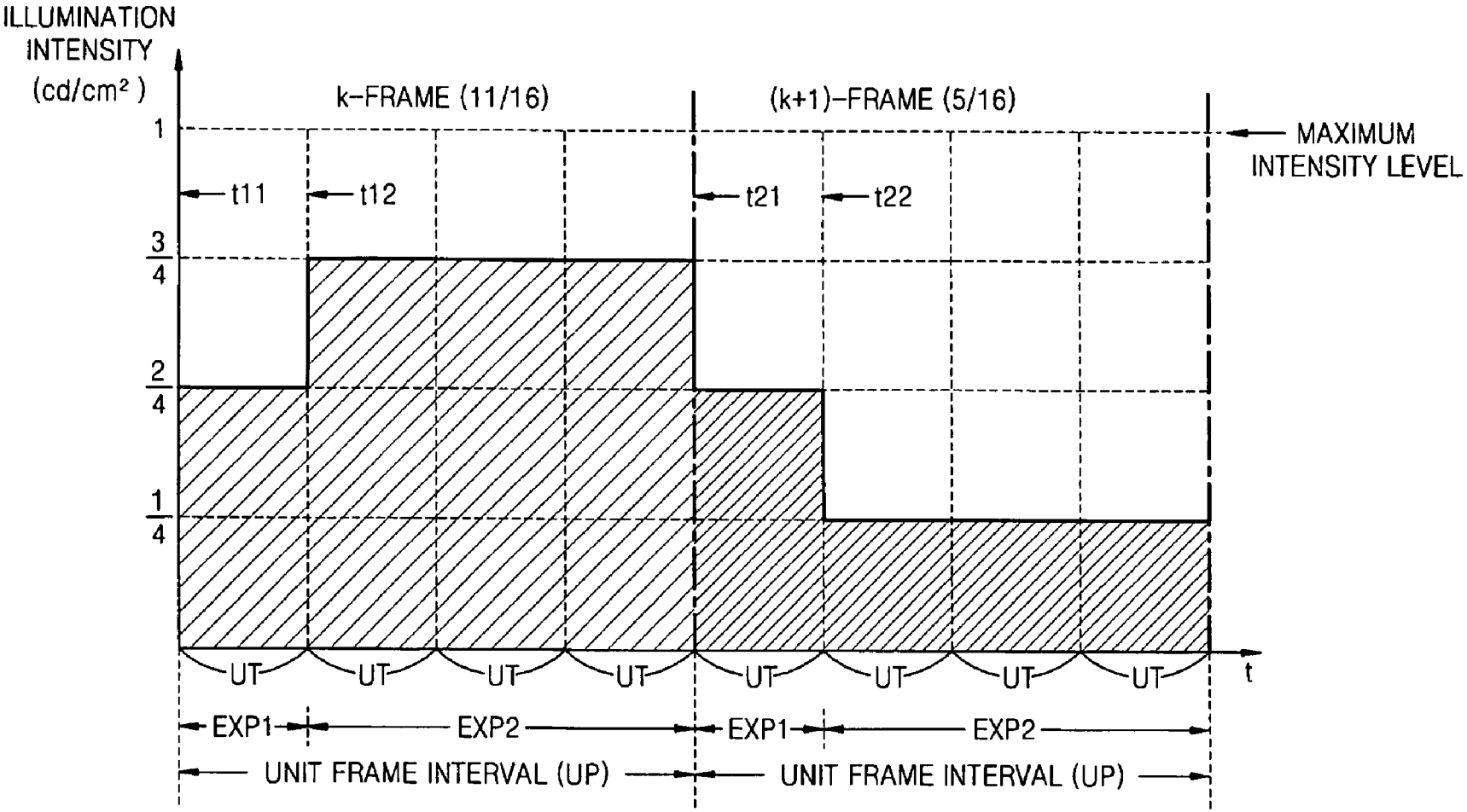
FIG. 5 shows an example of using the exemplary mapping table of FIG. 4.

FIG. 5 shows an example of using the exemplary mapping table of FIG. 4. Referring to FIG. 5, in the X-axis of the mapping table, unit times UT of 4 ($=2^2$) are arranged. And, in the Y-axis of the mapping table, intensity levels of 4 ($=2^2$) are arranged. Therefore, in the maximum area of one-frame, 16 ($=2^2\times2^2$) sectors are included. That is, the number of sectors corresponds to the bit number of the digital data.

Also, the relative ratio of the second illumination intensity to the first illumination intensity is changed according to the value of the digital data. But the length of the first illumination interval EXP1 and the length of the second illumination interval EXP2 are independent from the digital data. So, according to the present invention, the number of the access time can be decreased.

In the example shown for the K-frame, the value of the digital data stands for (11/16), which means that the ratio of the corresponding illuminating amount to maximum illuminating amount is (11/16). And, in the example shown for the (K+1)-frame, the value of the digital data stands for (5/16), which means that the ratio of the corresponding illuminating amount to the maximum illuminating amount is (5/16).

In both cases of the K-frame and the (K+1)-frame, the selected pixel is illuminated with a first illumination intensity during the first illumination interval EXP1. And then, the selected pixel is illuminated with a second illumination intensity during the second illumination interval EXP2.

In the K-frame, the level of the first illumination intensity is (2/4) of the maximum intensity level, and the level of the second illumination intensity is (3/4) of the maximum intensity level. In the (K+1)-frame, the level of the first illumination intensity is (2/4) of the maximum intensity level, and the level of the second illumination intensity is (1/4) of the maximum intensity level.

In both cases of the K-frame and the (K+1)-frame, the first illumination interval EXP1 includes one unit time UT, and the second illumination interval EXP2 includes 3 unit times UT. That is, the length of the first illumination interval EXP1 and the length of the second illumination interval EXP2 are independent from the digital data.

Therefore, in the exemplary K-frame, the ratio of the corresponding illuminating amount to the maximum illuminating amount is (11/16), and 11 sectors are covered with the deviant lined area. That is to say, the ratio of the deviant lined area to the maximum area is (11/16), in the exemplary K-frame.

And, in the exemplary (K+1)-frame, the ratio of the corresponding illuminating amount to the maximum illuminating amount is (5/16), and 5 sectors are covered with the deviant lined area. That is to say, the ratio of the deviant lined area to the maximum area is (5/16), in the exemplary (K+1)-frame.

Meanwhile, the selected pixel is driven to be illuminated with the corresponding illumination intensity by only two times accesses. In other words, there are only two different illumination intensities, each occurring within an illumination interval, within the unit frame interval.

For the first illumination during the first illumination interval EXP1, the selected pixel is accessed at time t11 for the K-frame, and time t21 for the (K+1)-frame. And, for the second illumination during the second illumination interval EXP2, the selected pixel is accessed at time t12 for the K-frame, and time t22 for the (K+1)-frame.

The length of the second illumination interval EXP2 is different from that of the first illumination interval EXP1.

Figure 1:
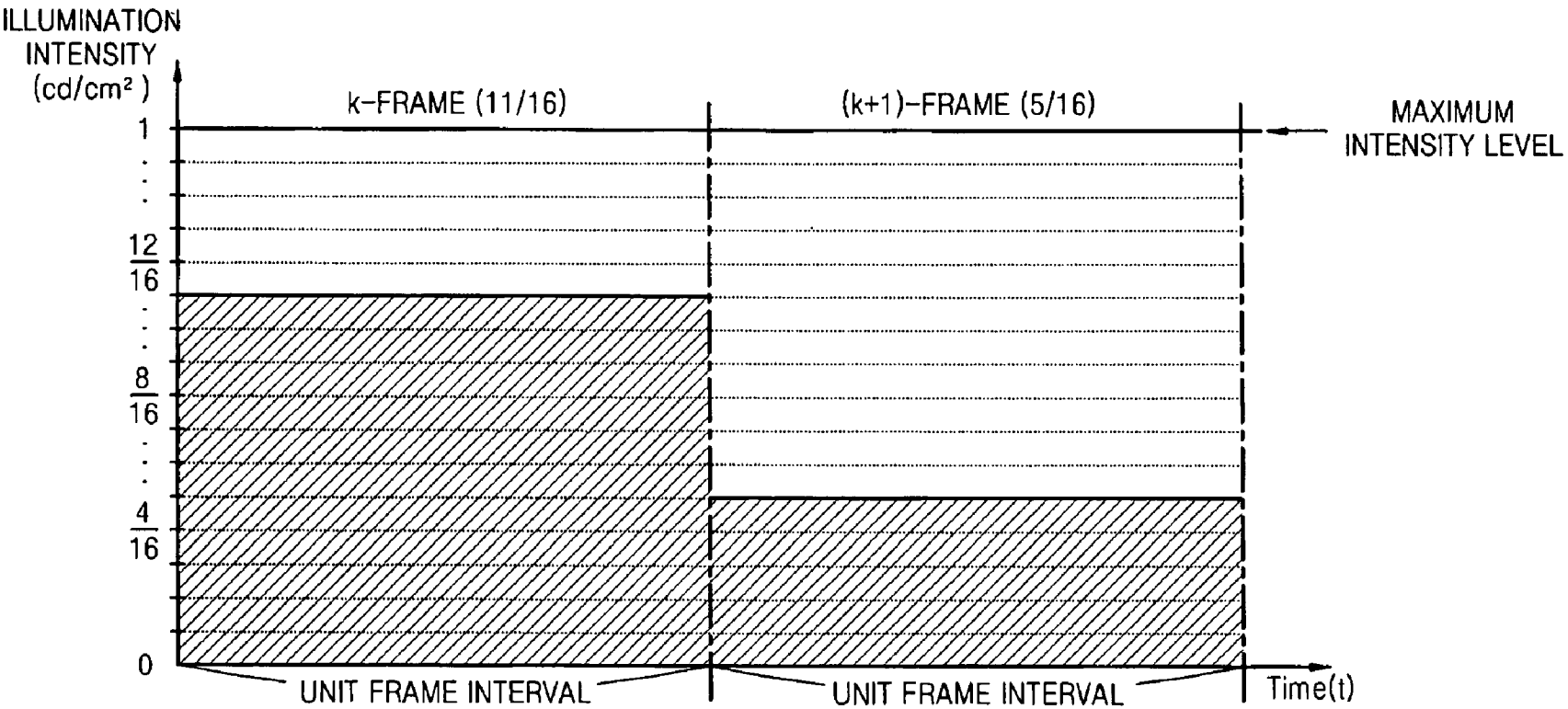
FIG. 1 (PRIOR ART)
FIG. 1 is a drawing for describing a conventional pixel driving method according to the prior art.

As shown in FIG. 4 and FIG. 5, the number of the intensity levels is 4, if the digital data is 2-bit data. Therefore, 2-bit DAC may be adapted for the mixing type pixel driving method of the present invention. Therefore, considering that 4-bit DAC is necessary for the conventional pixel driving method of FIG. 1 according to the prior art, the layout area and the consumption current can be decreased according to the present invention.

Extending the present invention to a general case, when the digital data is n-bit data, unit times of $2^i$ are arranged in the X-axis of the mapping table. And, in the Y-axis of the mapping table, intensity levels of $2^i$ are arranged. Therefore, in the maximum area of one-frame, 16 ($=2^2\times2^2$) sectors are included. Herein, n is a natural number more than 2. Also, i and j are natural numbers. Preferably, the sum of i and j is n. More preferably, i and j are the same number. But, it should be understood to those skilled in the art that the spirit of the present invention is still embodied, even if i is different from j.

Figure 6:
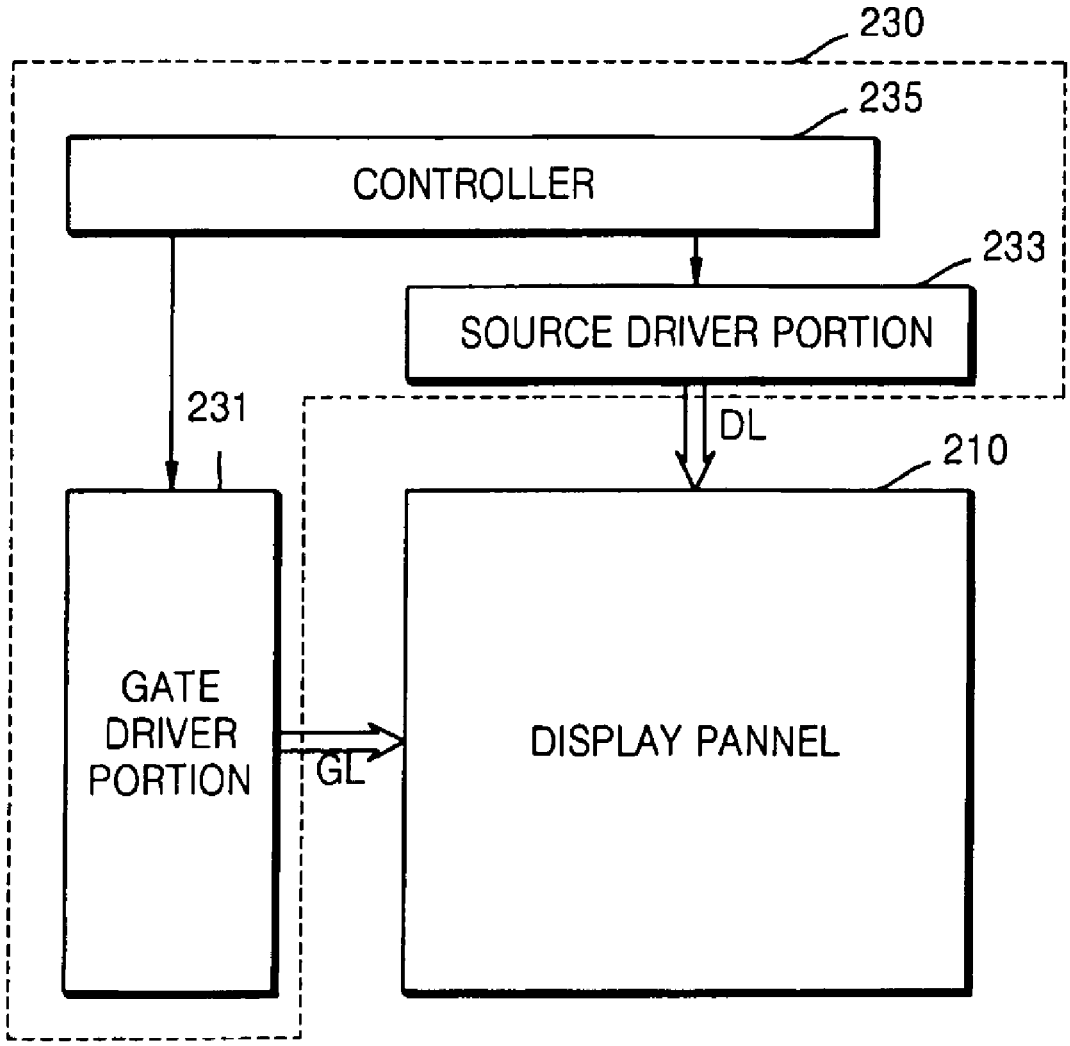
FIG. 6 is a drawing showing an exemplary active display device for the exemplary pixel driving method according to the present invention.

FIG. 6 is a drawing showing an exemplary active display device for the exemplary pixel driving method according to the present invention.

Referring to FIG. 6, the active display device of the present invention includes a display panel 210 and a driving circuit 230. The display panel 210 includes a plurality of pixels (not shown in FIG. 6).

The driving circuit 230 generates a digital data for a selected pixel. The driving circuit 230 drives the selected pixel to be illuminated with a first illumination intensity during a first illumination interval. The driving circuit 230 drives the selected pixel to be illuminated with a second illumination intensity during a second illumination interval. Herein, the second illumination intensity is different from the first illumination intensity.

The first and the second illumination intensity levels, and the first and the second illumination intervals are determined in a mapping table according to the digital data. The mapping table may be stored in the active display device. The first illumination interval and the second illumination interval are included in one unit frame period.

Also, a relative ratio of the second illumination intensity to the first illumination intensity is changed according to the value of the digital data.

The driving circuit 230 includes a gate driver portion 231, a source driver portion 233 and a controller 235. The gate driver portion 231 drives a gate line GL of the selected pixel. The source driver portion 233 supplies the corresponding digital data through the data line DL for illuminating the selected pixel. The controller 235 controls the gate driver portion 231 and the source driver portion 233, so that the selected pixel of the display panel 210 illuminates during the illumination interval with the illumination intensity. At this time, the illumination interval and the illumination intensity depend on the corresponding digital data.

Figure 7:
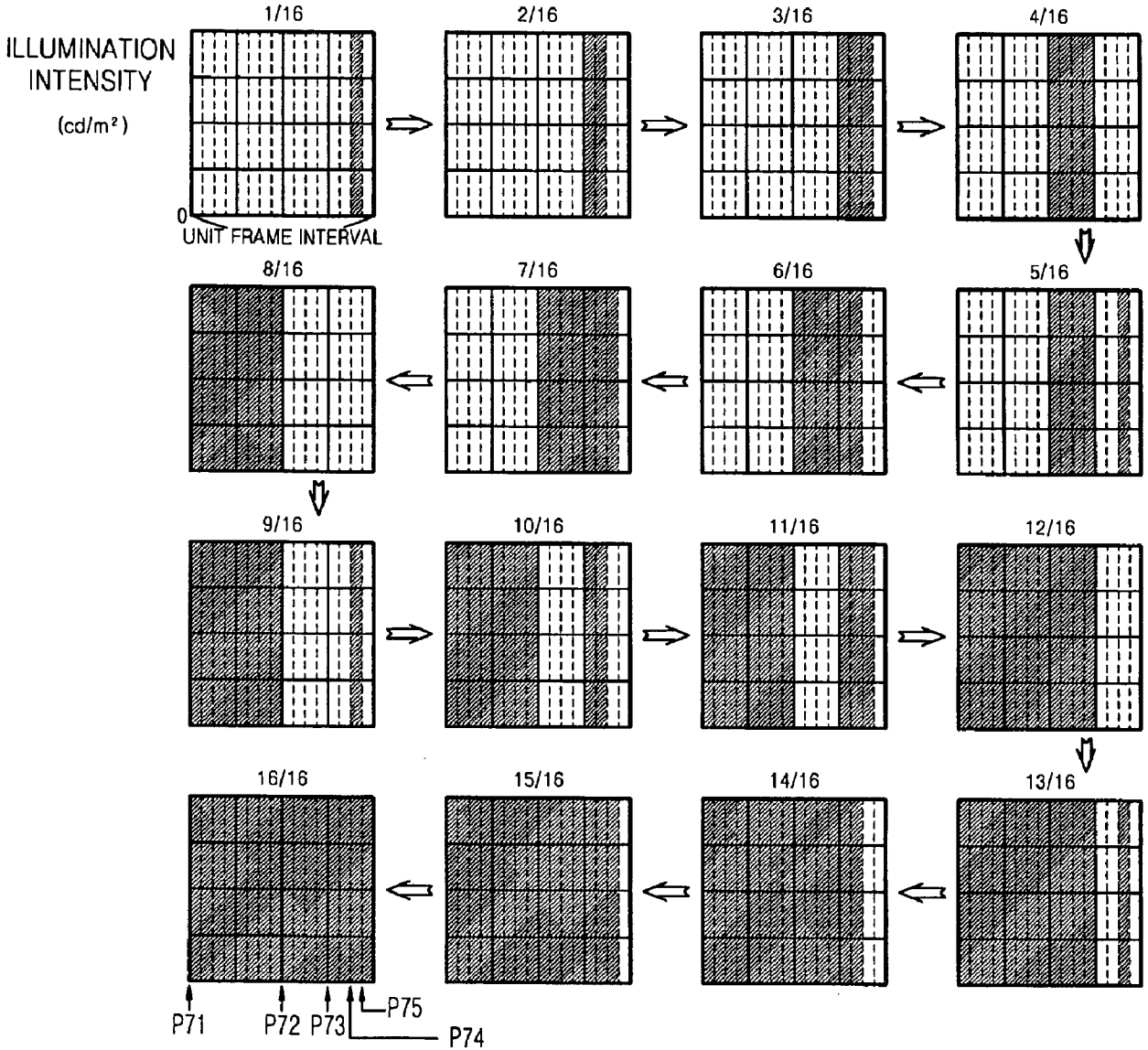
FIG. 7 is a mapping table to describe the pixel driving method according to a comparison example.

FIG. 7 is a mapping table to explain the pixel driving method according to the comparison example. The pixel driving method of FIG. 7 may be referred to as a 'digital driving method'.

In the pixel driving method according to the comparison example, the illumination intensity is constant, and the length of the illumination interval is changed according to the value of the digital data.

In the active display device for the pixel driving method of FIG. 7, DAC is not required. So, there are some advantages on the layout area.

However, in the pixel driving method of FIG. 7, 5 time accesses are required for illuminating the selected pixel (Refer to p71, p72, p73, p74 and p75). That is, the pixel driving method of FIG. 7 requires more time accesses as compared to the exemplary pixel driving method of the present invention.

Therefore, in the active display device for the pixel driving method of FIG. 7, there are some disadvantages on the operating speed and consumption current.

According to the mixing type pixel driving method of the present invention, the number of the converted bits by DAC is reduced. Therefore, the reduced bit DAC is adaptable for the mixing type pixel driving method of the present invention.

Therefore, the layout area and the consumption current can be decreased according to the present invention.

Although exemplary embodiments of the present invention have been disclosed for illustrative purposes, those skilled in the art will appreciate that various modifications, additions and substitutions are possible, without departing from the scope and spirit of the invention as disclosed in the accompanying claims. Therefore, the technical scope of the present invention should be defined by the technical spirit of the accompanying claims.

What is claimed is:

1. A method of driving an active display device, the method comprising:

generating a digital data for one selected pixel;

first driving the same selected pixel to be illuminated with a first illumination intensity in a first illumination interval;

second driving the selected pixel to be illuminated with a second illumination intensity in a second illumination interval; and controlling the first and second illumination intensity directly by an analog signal from a driver, wherein the first illumination intensity and the second illumination intensity, and the first and the second illumination intervals are determined in a mapping table according to the digital data and the first illumination intensity and the second illumination intensity are different from each other;

the first illumination interval and the second illumination interval are included in one unit frame period; and a length of the first illumination interval and a length of the second illumination interval are independent from the digital data, the length of the second illumination interval is different from the length of the first illumination interval and a relative ratio of the second illumination intensity to the first illumination intensity is changed according to a value of the digital data.

2. The method of claim 1, wherein the digital data includes n bits, wherein n is a positive integer more than 2.

3. The method of claim 2, wherein the mapping table includes a combination of 2*i* unit times and 2*j* intensity levels, wherein i and j are positive integers, and n is same as a sum of i and j, and wherein the unit frame period includes the 2*i* unit times.

4. The method of claim 3, wherein j is same as i.

5. The method of claim 3, wherein j is different from i.

6. The method of claim 3, wherein the length of the first illumination interval is same as that of one unit time.

7. The method of claim 6, wherein the length of the second illumination interval is same as that of (2*i*-1) unit times.

8. An active display device, comprising:

a display panel including a plurality of pixels; and a driving circuit which generates a digital data for one selected pixel, drives the selected pixel to be illuminated with a first illumination intensity in a first illumination interval, and drives the same selected pixel to be illuminated with a second illumination intensity in a second illumination interval, wherein the first illumination intensity and the second illumination intensity are determined according to the digital data and are different from each other and wherein the length of the first illumination interval is different from the length of the second illumination interval;

the first illumination interval and the second illumination interval are included in one unit frame period; and a length of the first illumination interval and a length of the second illumination interval are independent from the digital data, and a relative ratio of the second illumination intensity to the first illumination intensity is changed according to a value of the digital data.

9. The active display device of claim 8, wherein the driving circuit includes a gate driver portion which drives a gate line of the selected pixel, a source driver portion which supplies the digital data through a data line to illuminate the selected pixel, and a controller which controls the gate driver portion and the source driver portion.

10. The active display device of claim 9, wherein the controller controls the gate driver portion and the source driver portion so that the selected pixel of the display panel illuminates during the first illumination interval with the first illumination intensity and during the second illumination interval with the second illumination intensity.

11. The active display device of claim 8, wherein a sum of the first illumination intensity times the length of the first illumination interval, and the second illumination intensity times the length of the second illumination interval equals a desired illuminating amount for the selected pixel.

12. The active display device of claim 11, wherein the desired illuminating amount is one of a plurality of illuminating amounts stored in a mapping table, and at least some of the illuminating amounts include the first illumination intensity that is different from the second illumination intensity.

13. The active display device of claim 8, wherein the selected pixel is driven to be illuminated by only two time accesses.

14. The active display device of claim 8, further comprising a mapping table stored within the active display device, wherein, for each of a plurality of different illuminating amounts of the selected pixel, the mapping table stores the first illumination intensity, the first illumination interval, the second illumination intensity, and the second illumination interval.

15. The active display device of claim 14, wherein, in the mapping table, at least some of the illuminating amounts include the first illumination intensity that is different from the second illumination intensity.

16. A method of driving an active display device, the method comprising:

generating a digital data for one selected pixel;

first driving the selected pixel to be illuminated with a first illumination intensity in a first illumination interval;

second driving the same selected pixel to be illuminated with a second illumination intensity in a second illumination interval; and controlling the first and second illumination intensity directly by an analog signal from a driver, wherein, the first illumination interval and the second illumination interval are included in one unit frame period; and, for each of a plurality of different illuminating amounts of the selected pixel, a mapping table stores the first illumination intensity, the first illumination interval, the second illumination intensity, and the second illumination interval according to the digital data, and the first illumination intensity and second illumination intensity are different from each other and wherein the length of the first illumination interval is different from the length of the second illumination interval.

17. The method of claim 16, wherein, in the mapping table, at least some of the illuminating amounts include the first illumination intensity that is different from the second illumination intensity.

* * * * *